United States Patent [19]

Lauer et al.

[11] Patent Number: 4,569,597

[45] Date of Patent: Feb. 11, 1986

[54] SOLIDS BLENDING APPARATUS

[75] Inventors: Leonard Lauer, New York; Jacqueline Goldberg, Roslyn, both of N.Y.

[73] Assignee: United Utensils Company, Inc., Port Washington, N.Y.

[21] Appl. No.: 743,288

[22] Filed: Jun. 11, 1985

Related U.S. Application Data

[63] Continuation of Ser. No. 659,363, Oct. 10, 1984, abandoned.

[51] Int. Cl.[4] ..... B01F 9/06

[52] U.S. Cl. ..... 366/228

[58] Field of Search ..... 366/220, 225, 226, 227, 366/228, 229, 230, 231, 213, 218, 307, 341, 342, 54, 56, 57

[56] References Cited

U.S. PATENT DOCUMENTS

| | | | |
|---|---|---|---|
| 85,967 | 1/1869 | Saladee . | |
| 2,860,837 | 1/1959 | Pickin . | |
| 3,137,327 | 6/1964 | Muench | 366/220 |
| 3,341,183 | 9/1967 | Bergstrom . | |
| 4,286,883 | 9/1981 | Johanson . | |
| 4,372,686 | 2/1983 | Herfeld | 366/220 |

FOREIGN PATENT DOCUMENTS

| | | |
|---|---|---|
| 798085 | 7/1958 | United Kingdom . |
| 1249883 | 10/1971 | United Kingdom . |
| 1268625 | 3/1972 | United Kingdom . |

*Primary Examiner*—Robert W. Jenkins

*Attorney, Agent, or Firm*—St. Onge, Steward, Johnston & Reens

[57] ABSTRACT

An apparatus is described for blending solids in an efficient and uniform manner by rotating the apparatus about an axis. A container is provided with at least first and second baffle plates that are arranged in crossing relationship. The baffles have opposite guide surfaces which are oriented near parallel to the rotational axis so as to face the direction of rotation. The baffles are placed generally centrally inside the container and extend generally from the vicinity of one container side to the vicinity of the other side of the container. A significant improvement in the mixing of different solids is obtained.

13 Claims, 5 Drawing Figures

SOLIDS BLENDING APPARATUS

This is a continuation of application Ser. No. 659,363 filed on Oct. 10, 1984, abandoned.

FIELD OF THE INVENTION

This invention relates to an apparatus for the blending of solids such as powders and granulated solids and the like.

BACKGROUND OF THE INVENTION

Devices for the blending of solids are well known in the art. For example, in the Great Britain Pat. Nos. 798,085 and 1,268,625 a container having conical end sections separated by a cylindrical mid-section is described to blend solids. In one patent a deflector plate is mounted in a mid-section of the container to aid in the blending of the solids, while in the other patent a pair of plates are respectively placed in the conical end sections. These plates are so placed in the container that when it is rotated some enchanced mixing may occur.

In U.S. Pat. No. 3,341,183, to Bergstrom et al, a solids blender is described using a baffle system formed of specially shaped deflectors mounted in a bridge structure located inside a container. The orientation of the plates in the above mentioned British patents and the Bergstrom patent et al is such that the plates or deflectors appear edge-on when the container is in a vertical position and is viewed from the direction of rotation. Such blender bridge structure is elaborate and, therefore, expensive and not necessarily efficient and sufficiently uniformly effective throughout the volume inside the container.

In U.S. Pat. No. 85,967 a churn is described for milk. This includes a double frustro-conical container inside of which is a double dash structure onto which milk is broken as the container is rotated.

SUMMARY OF THE INVENTION

With an apparatus in accordance with the invention solids are more uniformly blended in a rotating blender with a high degree of efficiency. This is accomplished with a blender in which at least first and second baffles are disposed inside a container in a crossing relationship. The baffles each have opposite guide surfaces which are aligned preferably near parallel with the rotational axis of the blender and thus face the direction of rotation. As the container is rotated the solids tumble onto the guide surfaces which, due to their orientation, tend to rotationally move and guide solids from one side to the other.

As described herein for a preferred form of the invention, the baffles extend from a location that is spaced from, but in the vicinity of one container side to a location that is spaced from, but in the vicinity of another opposite container side. The crossed relationship of the baffles tend to further introduce a bulk shearing of the solids which are moved and guided by the baffles to opposite container sides.

With a blender in accordance with the invention a significantly improved blending of solids was achieved with blended samples varying from one another in a statistically significant small amount. As a result blending can be achieved within a more efficient blending time with greater uniformity.

It is, therefore, an object of the invention to provide an apparatus with which solids can be blended with greater efficiency and improved uniformity.

Normally, features of solids bin design which remarkably improve the discharge of solids from a container after storage frequently impair blending properties. Inversely, features which enhance blending often impede optimal discharge and flow of solids. With the present invention a bin structure is provided with which different solids can be efficiently and uniformly blended as well as subsequently discharged in an optimal manner at a uniform discharge rate and minimal variation in bulk density.

These and other advantages and objects of the invention can be understood from the following detailed description of a preferred embodiment as shown in the drawings.

DETAILED DESCRIPTION OF DRAWINGS

Figure 1:
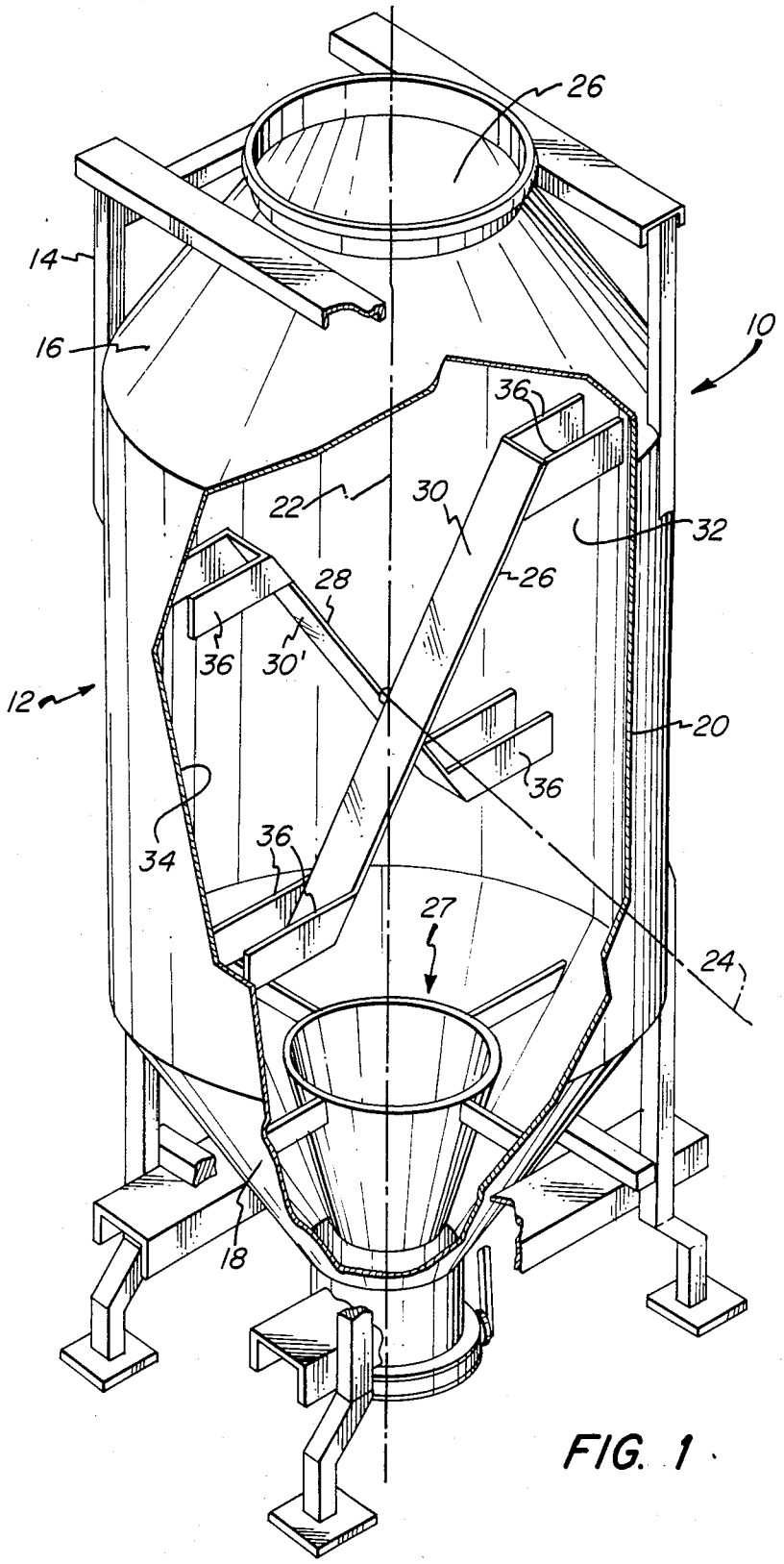
FIG. 1 is a perspective broken away view of one solids blender apparatus in accordance with the invention.

With reference to FIG. 1 an apparatus 10 is shown for storing solids such as powders or other granulated materials. The apparatus 10 is shown formed with a bin structure 12 and a support 14. The bin structure has frusto-conically shaped ends 16, 18, and a cylindrical mid-section 20, all of which are in coaxial alignment with a longitudinal axis 22. The support 14 enables the apparatus 10 to stand or be moved as well as be gripped for rotational blending about a horizontal axis 24 with a rotator (not shown).

The bin structure 12 and support 14 may have different shapes and are illustrated here as part of one embodiment found particularly effective in one blending application. Other bin structure configurations can be used as illustrated in some of the aforementioned prior art patents. Similarly the support 14 is shown as illustrative for one embodiment and other support techniques and devices can be used.

The frusto-conical end 16 serves to receive solids to be blended through opening 26 and has a suitable cover, not shown, for closing the opening 26. Frusto-conical end 18 serves to discharge blended solids in a manner that prevents erratic, funnel flow of blended solids by using a conical discharge apparatus 27 as more particularly described in U.S. Pat. No. 4,286,883 to J. Johanson. This type of conical discharge arrangement is not essential in practicing the invention.

Blending of solids is achieved by rotating the apparatus about a horizontal axis. Within mid-section 20 at least first and second flat baffle plates 26, 28 are mounted. Each baffle has a pair of opposite flat guide surfaces 30, 30' with the baffles being so mounted that guide surfaces are generally parallel to rotational axis 24. Baffles 26, 28 are mounted in side by side crossing relationship, (generally with a crossing angle of about 90°), so that, as the apparatus 10 is rotated solids are moved and guided in opposite directions.

Baffles 26, 28 are mounted so that their guide surfaces 30, 30' extend from locations that are spaced from, but in the vicinity of opposite sides 32, 34 of mid-section 20. Brackets such as 36 are used to locate the baffles 26, 28 and are welded to both the sides 32, 34 of mid-section 20 as well as to baffles 26, 28. The entire bin structure 12 is typically made of stainless steel.

Figures 2, 3, 4, 5:
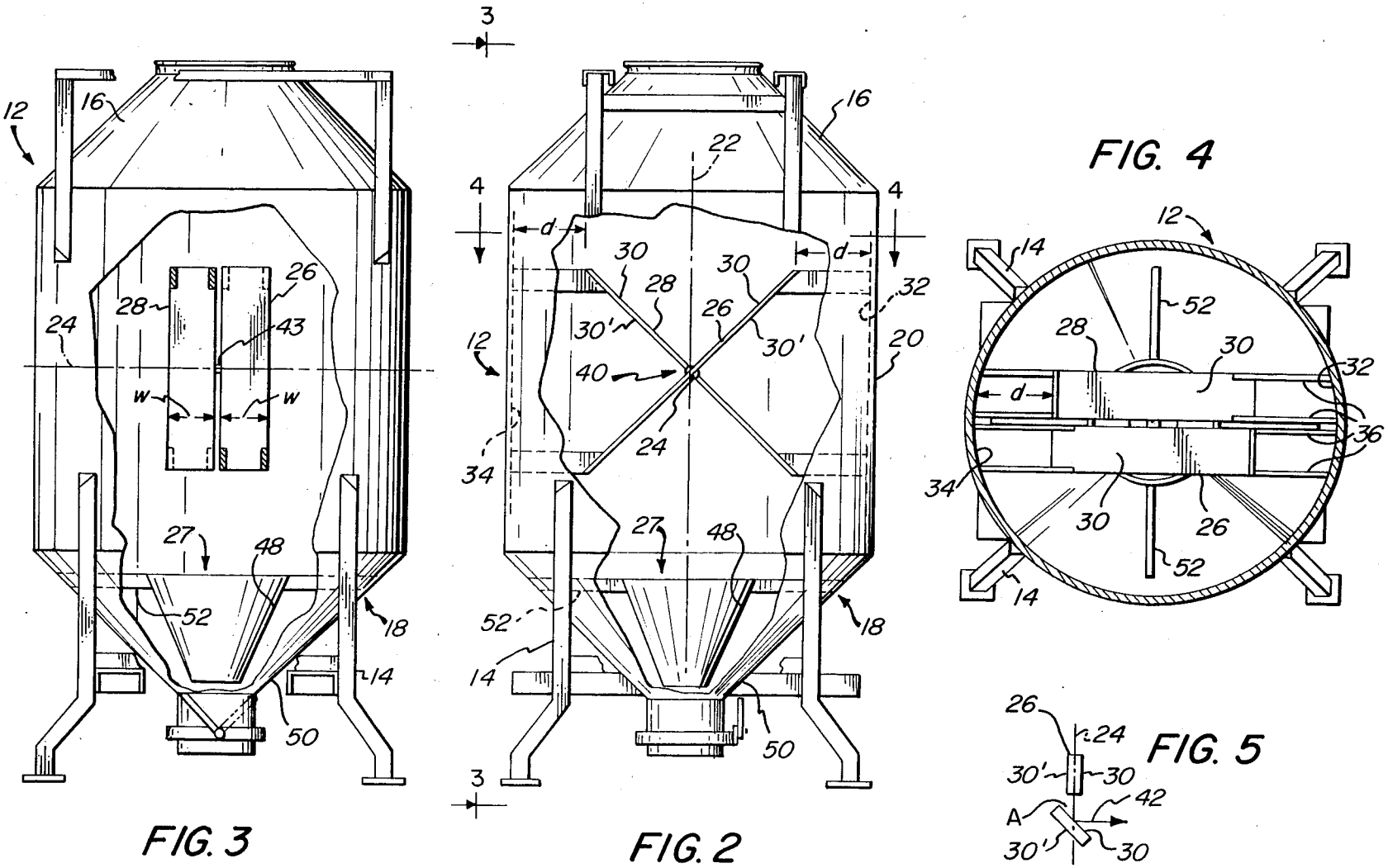
FIG. 2 is a side view in elevation, partially broken away, of the blender apparatus of FIG. 1 but taken along the axis of rotation for the apparatus.
FIG. 3 is a similiar view as FIG. 2 but is taken in the direction of rotation along the lines 3—3 in FIG. 2.
FIG. 4 is top section view of the blender apparatus of FIG. 2 taken along the lines 4—4 therein.
FIG. 5 is a projection of a baffle onto the axis of rotation for different orientations of that baffle relative to the rotational axis.

FIGS. 2–4 further illustrate the baffles 26, 28 in relation to the bin structure 12. Baffles 26, 28 are placed generally centrally within the mid-section 20. The place 40 where the baffles 26, 28 cross lies in a plane 41 which crosses the mid-section 20 generally transverse to the longitudinal axis 22. Crossing point 40 is in the vicinity of the middle of mid-section 20 near the longitudinal axis 22. The ends of the baffles 26, 28 terminate in spaced relationship from the sides 32, 34 at a distance selected so as not to interfere with the normal blending process that takes place near the wall of the mid-section 20 during its rotation. This distance is a function of the crossectional dimension of the mid-section 20 and typically is of the order of about 20% of that dimension. The baffles 26, 28, therefore, are so sized and oriented so that their guide surfaces terminate in the vicinity of each of the sides 32, 34 but at opposite sides of the crossing plane 41.

The width, W, of baffles 26, 28 is selected so that the crossectional dimension of the bin structure 20 as viewed along the rotational axis 24 is substantially larger than the combined width, 2w, of baffles 26, 28. A combined width 2w of about 25% of the crossectional dimension has been found satisfactory, though this may be increased or decreased for particular applications.

The baffles 26, 28 further have guide surfaces 30,30' which preferably extend in a generally uninterrupted manner from one end of the baffle to the other and thus from the vicinities of sides 32, 34. In some cases cross-elements (not shown) or holes (not shown) may be added to baffles 26, 28 to achieve particular blending results.

With the location of the baffles 26, 28 blending is enhanced in the central region of the bin structure 20. The orientation of baffles 26, 28, i.e. with their guide surfaces 30, 30' generally parallel to the rotational axis, enhances mixing action by the baffles of the solids.

As shown in FIG. 5 the orientation of the guide surfaces 30,30' may vary from being parallel to rotational axis 24. Preferably the guide surfaces 30,30' are within a desired angular range from being parallel while still effectively facing the solids in the direction 42 of rotation. The angle A between the guide surfaces 30, 30' and rotational axis 24 may be as much as 45° but preferable is less than about 15° to being parallel with the axis.

The rotational axis 24 need not be coincident with place 40 where baffles 26, 28 cross and might be above or below that. The baffles 26, 28 are joined at place 40 with a suitable small spacer 43 welded to both baffles.

With a solids blender in accordance with the invention the solids can be discharged through a discharge valve (not shown) by uniform mass flow of blended solids. This is obtained with a double conical structure 27 as described in U.S. Pat. No. 4,286,883. This includes an inner cone 48 inside and coaxial with an outer cone 50. Struts 52 are used to space inner cone 48 from outer cone 50. The respective cone angles of cones 48 and 50 and the relative vertical positions of the cones are so selected as to obtain a uniform, mass flow discharge of the blended solids. The cone within a cone configuration produces the desired uniform mass flow discharge with minimal height requirement since this arrangement allows the angle to the horizontal of the outer cone wall to be only half the angle required in a single cone design which will produce the same uniform mass flow discharge.

With a solids blender in accordance with the invention the solids can be blended with significantly enhanced uniformity with a high efficiency, i.e. with a relatively few number of rotations. For example in comparison with a control blender having pyramid end sections and a square shaped mid-section, the blender of this invention demonstrated a maximum blending variation from a mean value from −15% to +30% with a standard deviation of 0.439, in contrast with −45% to +70% with a standard deviation of 2.849 for the control blender.

Having thus described a blending apparatus in accordance with the invention its advantages can be appreciated. Variations from the embodiment can be made without departing from the scope of the invention as set forth in the claims. For example, baffles 26, 28 may be made other than flat such as of different curvatures as viewed along the rotational axis 24.

What is claimed is:

1. An apparatus for the blending of solids, comprising:

a container for storing a supply of solids to be blended by tumbling from one end to the other end of the container during rotation of the container about a desired axis of rotation;

at least first and second baffles arranged inside the container in crossing relationship to each other as viewed along the axis of rotation;

said first baffle having opposite longitudinal guide surfaces, said first baffle being affixed inside the container with an orientation that places its guide surfaces within a desired angular range from being parallel to the axis of rotation, said first baffle being sized in length so that its guide surfaces extend from a location that is in the vicinity of one container side to a location in the vicinity of another container side that is opposite to said one side, the width of said longitudinal guide surfaces being substantially less than the dimension of the container as measured along said axis of rotation;

said second baffle having opposite longitudinal guide surfaces, said second baffle being affixed inside the container with an orientation that places the latter guide surfaces within a desired angular range from being parallel to the axis of rotation, said second baffle being sized in length so that its guide surfaces extend from a location that is in the vicinity of said one container side to a location that is in the vicinity of said other container side, the width of the longitudinal guide surfaces of the second baffle being substantially less than said axial dimension of the container;

whereby upon rotation of said container about said axis, solids are tumbled onto said baffles and are respectively moved and guided by them towards respectively opposite sides of the container.

2. The blending apparatus as claimed in claim 1 wherein a point in the crossing of the baffles lies in a plane that crosses the container, with said first and second baffles each extending from one side of said plane to the other side of the plane.

3. The blending apparatus as claimed in claim 1 wherein said guide surfaces are within an angular range of generally less than about 45° from being parallel with the rotational axis.

4. The blending apparatus as claimed in claim 3 wherein said guide surfaces are within an angular range of generally less than about fifteen degrees from being parallel to the rotational axis.

5. The blending apparatus as claimed in claim 4 wherein the first and second baffles are flat.

6. The blending apparatus as claimed in claim 1 wherein said first and second baffles are placed adjacent to each other.

7. The blending apparatus as claimed in claim 1 wherein said first and second baffles cross at a place that is in the vicinity of the rotational axis.

8. The blending apparatus as claimed in claim 1 wherein the first and second baffles form a crossing angle of the order of about ninety degrees.

9. The blending apparatus as claimed in claim 1 wherein said container has frusto-conical ends and has a cylindrical mid-section, with said first and second baffles generally centrally mounted in the cylindrical mid-section.

10. The blending apparatus as claimed in claim 1 wherein the baffles have substantially uninterrupted guide surfaces.

11. The blending apparatus as claimed in claim 1 wherein the guide surfaces of said first and second baffles extend between locations that are not spaced from the container sides.

12. A container for the blending of solids comprising:

a container for storing a supply of solids to be blended by tumbling during rotation of the container about a desired axis of rotation, said container having oppositely located conically shaped end sections and a cylindrical mid-section therebetween with said axis being in a plane that crosses the mid-section;

a first mixer plate having opposite longitudinal guide surfaces, said plate being affixed inside the container mid-section with an orientation that places the guide surfaces generally parallel to the axis of rotation, said plate being sized in length so that its guide surfaces extend in an effectively uninterrupted manner from the vicinity of one side of the mid-section on one side of the plane to the vicinity of another mid-section side that is opposite to said one side and on the other side of the plane, the width of said longitudinal guide surfaces being substantially less than the dimension of the container as measured along said axis;

a second mixer plate having opposite longitudinal surfaces, said plate being affixed inside the container mid section alongside of the first plate with an orientation that places the latter guide surfaces generally parallel to the axis of rotation, said second plate being sized in length so that its guide surfaces extend in an effectively uninterrupted manner from the vicinity of said one side of the mid-section on the other side of the plane to the vicinity of said other mid-section side and on the other side of the plane so that said first and second mixer plates are in a crossing relationship with each other as viewed along the axis of rotation;

one of said conical end sections being provided with a second conically shaped element selected to enable the discharge of solids by uniform mass flow with a significant saving of overall height.

13. An apparatus for the blending of solids, comprising:

a container for storing a supply of solids to be blended by tumbling from one end to the other end of the container during rotation of the container about a desired axis of rotation;

at least first and second baffles arranged inside the container in crossing relationship to each other as viewed along the axis of rotation;

said first baffle having opposite longitudinal guide surfaces, said first baffle being affixed inside the container with an orientation that places its guide surfaces generally parallel to the axis of rotation, said first baffle being sized in length and shaped so that its guide surfaces extend in an uninterrupted manner from a location that is spaced from one container side to a location spaced from another container side that is opposite to said one side, the width of said longitudinal guide surfaces being substantially less than the dimension of the container as measured along said axis of rotation;

said second baffle having opposite longitudinal guide surfaces, said second baffle being affixed inside the container with an orientation that places the latter guide surfaces generally parallel to the axis of rotation, said second baffle being sized in length so that its guide surfaces extend in an uninterrupted manner from a location spaced from said one container side to a location spaced from said other container side, the width of the longitudinal guide surfaces of the second baffle being substantially less than said axial dimension of the container;

whereby upon rotation of said container about said axis, solids are tumbled onto said baffles and are respectively moved and guided by them towards respectively opposite sides of the container.

* * * * *